US006915856B2

(12) United States Patent
Gentry et al.

(10) Patent No.: US 6,915,856 B2
(45) Date of Patent: Jul. 12, 2005

(54) APPARATUS AND METHODS FOR PREVENTING AXIAL MOVEMENT OF DOWNHOLE TOOL ASSEMBLIES

(75) Inventors: Mark C. Gentry, The Woodlands, TX (US); Timothy J. Hall, Houston, TX (US); Kevin H. Searles, Kingwood, TX (US); William A. Sorem, Katy, TX (US); Scott R. Clingman, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 89 days.

(21) Appl. No.: 10/445,217

(22) Filed: May 23, 2003

(65) Prior Publication Data

US 2003/0221833 A1 Dec. 4, 2003

Related U.S. Application Data

(60) Provisional application No. 60/384,870, filed on May 31, 2002.

(51) Int. Cl.[7] ..... E21B 23/04

(52) U.S. Cl. ..... 166/382; 166/120; 166/213; 166/387

(58) Field of Search ..... 166/118, 120, 166/123, 125, 172, 177.3, 181, 213, 382, 387

(56) References Cited

U.S. PATENT DOCUMENTS

| | | | | |
|---|---|---|---|---|
| 3,270,819 | A | 9/1966 | Thrane et al. | 166/124 |
| 3,446,281 | A | 5/1969 | Watkins | 166/214 |
| 3,570,599 | A | 3/1971 | Wilson et al. | 166/208 |
| 4,060,131 | A | 11/1977 | Kenneday et al. | 166/315 |
| 4,156,460 | A | 5/1979 | Crowe | 166/120 |
| 4,627,491 | A | 12/1986 | Zunkel | 166/126 |
| 4,709,758 | A | 12/1987 | Preston, Jr. | 166/120 |
| 4,712,614 | A | 12/1987 | Allwin et al. | 166/208 |
| 4,854,386 | A | 8/1989 | Baker et al. | 166/289 |
| 4,926,936 | A | 5/1990 | Braddick | 166/217 |
| 5,058,672 | A | 10/1991 | Cochran | 166/124 |
| 5,092,402 | A | 3/1992 | Perricone et al. | 166/113 |
| 5,095,979 | A | 3/1992 | Perricone | 166/138 |
| 5,267,617 | A | 12/1993 | Perricone et al. | 166/387 |
| 6,257,339 | B1 | 7/2001 | Haugen et al. | 166/387 |

FOREIGN PATENT DOCUMENTS

| | | | |
|---|---|---|---|
| CA | 2081701 | 6/1995 | E21B/33/12 |
| CA | 2165909 | 6/1996 | E21B/33/126 |
| GB | 2 198 769 A | 6/1988 | E21B/23/00 |
| GB | 2 256 664 A | 12/1992 | E21B/33/04 |
| GB | 2 268 767 A | 1/1994 | E21B/33/129 |
| GB | 2 291 450 A | 1/1996 | E21B/33/128 |
| GB | 2 304 765 A | 3/1997 | E21B/23/04 |
| GB | 2 309 721 A | 8/1997 | E21B/23/01 |

OTHER PUBLICATIONS

International Search Report mailed May 21, 2004 to corresponding PCT Application No. PCT/US03/16548, filed May 27, 2003, 3 pages.

*Primary Examiner*—Zakiya Walker
(74) *Attorney, Agent, or Firm*—ExxonMobil Upstream Research

(57) ABSTRACT

A slip assembly apparatus is adapted (i) to be deployed into a wellbore (ii) to prevent axial movement of a downhole tool assembly in the wellbore when the slip assembly apparatus is actuated and external forces are imposed on the downhole tool assembly; (iii) to allow fluid flow past the slip assembly apparatus within the wellbore when the slip assembly apparatus is actuated or non-actuated; and (iv) to allow release of the slip assembly apparatus by use of a release load that is less than the axial capacity of the deployment mechanism. Different embodiments of the invention contain features such as claddings and treatments for surface hardness and wear resistance, and grooves or flutes for enhancing fluid flow between the outer diameter of the slip assembly and the inner diameter of the well casings.

20 Claims, 6 Drawing Sheets

APPARATUS AND METHODS FOR PREVENTING AXIAL MOVEMENT OF DOWNHOLE TOOL ASSEMBLIES

This application claims the benefit of U.S. Provisional Application No. 60/384,870, filed 31 May 2002.

FIELD OF THE INVENTION

This invention relates generally to the field of perforating and treating subterranean formations to increase the production of oil and gas therefrom. More specifically, the invention provides an apparatus and method for preventing axial movement of an assembly of downhole equipment used to perforate and treat subterranean formations.

BACKGROUND OF THE INVENTION

When a hydrocarbon-bearing, subterranean reservoir formation does not have enough permeability or flow capacity for the hydrocarbons to flow to the surface in economic quantities or at optimum rates, hydraulic fracturing or chemical (usually acid) stimulation is often used to increase the flow capacity. A wellbore penetrating a subterranean formation typically includes a metal pipe (casing) cemented into the original drill hole. Holes (perforations) are placed to penetrate through the casing and the cement sheath surrounding the casing to allow hydrocarbon flow into the wellbore and, if necessary, to allow treatment fluids to flow from the wellbore into the formation.

Hydraulic fracturing comprises injecting fluids (usually viscous shear thinning, non-Newtonian gels or emulsions) into a formation at such high pressures and rates that the reservoir rock fails and forms a planar, typically vertical, fracture (or fracture network) much like the fracture that extends through a wooden log as a wedge is driven into it. Granular proppant materials, such as sand, ceramic beads, or other materials, are generally injected with the later portion of the fracturing fluid to hold the fracture(s) open after the fluid pressure is released. Increased flow capacity from the reservoir results from the flow path left between grains of the proppant material within the fracture(s). In chemical stimulation treatments, flow capacity is improved by dissolving materials in the formation or otherwise changing formation properties.

Application of hydraulic fracturing as described above is a routine part of petroleum industry operations as applied to individual target zones of up to about 60 meters (200 feet) of gross, vertical thickness of subterranean formation. When there are multiple or layered reservoirs to be hydraulically fractured, or a very thick hydrocarbon-bearing formation (over about 60 meters), then alternate treatment techniques are required to obtain treatment of the entire target zone.

When multiple hydrocarbon-bearing zones are stimulated by hydraulic fracturing or chemical stimulation treatments, economic and technical gains are realized by injecting multiple treatment stages that can be diverted (or separated) by various means, including mechanical devices such as bridge plugs, packers, downhole valves, sliding sleeves, and baffle/plug combinations; ball sealers; particulates such as sand, ceramic material, proppant, salt, waxes, resins, or other compounds; or by alternative fluid systems such as viscosified fluids, gelled fluids, foams, or other chemically formulated fluids; or using limited entry methods.

In mechanical bridge plug diversion, for example, the deepest interval is first perforated and fracture stimulated, then the interval is typically isolated by a wireline-set bridge plug, and the process is repeated in the next interval up.

Assuming ten target perforation intervals, treating 300 meters (1,000 feet) of formation in this manner would typically require ten jobs over a time interval of ten days to two weeks with not only multiple fracture treatments, but also multiple perforating and bridge plug running operations. At the end of the treatment process, a wellbore clean-out operation would be required to remove the bridge plugs and put the well on production. The major advantage of using bridge plugs or other mechanical diversion agents is high confidence that the entire target zone is treated. The major disadvantages are the high cost of treatment resulting from multiple trips into and out of the wellbore and the risk of complications resulting from so many operations in the well. For example, a bridge plug can become stuck in the casing and need to be drilled out at great expense. A further disadvantage is that the required wellbore clean-out operation may damage some of the successfully fractured intervals.

To overcome some of the limitations associated with completion operations that require multiple trips of hardware into and out of the wellbore to perforate and stimulate subterranean formations, methods and apparatus have been proposed for "single-trip" deployment of a downhole tool string to allow for fracture and chemical stimulation of zones in conjunction with perforating. Specifically, these methods and apparatus allow operations that minimize the number of required wellbore operations and time required to complete these operations, thereby reducing the stimulation treatment cost. The tool strings used for these types of applications can be very long and the tool assembly is subject to the erosive effect of proppant slurries when retained in the hole for multiple treatments. Stabilization and protection from damage of the tool assemblies becomes very important.

Further, excess friction pressure is generated when pumping stimulation fluids, particularly proppant-laden and/or high viscosity fluids, at high rates through long lengths of coiled tubing. Depending on the length and diameter of the coiled tubing, the fluid viscosity, and the maximum allowable surface hardware working pressures, pump rates could be limited to just a few barrels per minute; which, depending on the characteristics of a specific subterranean formation, may not allow effective placement of proppant during hydraulic fracture treatments or effective dissolution of formation materials during acid stimulation treatments.

In hydraulic fracturing operations, a sealing mechanism, such as a packer, can be used to provide isolation between the fracturing fluid and the lower portion of a cased wellbore. When the packer is activated or set within the casing below a region of perforations in a subterranean formation interval to be treated, the hydraulic fracturing fluid is directed into the perforations at high pressures to fracture the formation. When the high pressure fluid is applied above the set packer, there is a large axial downward force along the tool. Experiments have demonstrated that the frictional force between the packer and the casing wall is insufficient to balance the downward force. Therefore, a device, such as a slip assembly, is generally needed to react against the axial load from the fracturing fluid and prevent movement of the tool assembly downhole.

Slip assemblies are commonly used to stabilize a string of tools (i.e., a downhole tool assembly) during treatment operations by gripping the casing in resistance to axial forces in the set position. Slip assemblies can be actuated either hydraulically or mechanically. One example of a mechanically-actuated slip assembly known in the art uses a J-latch mechanism to set and unset the slip assembly by axial movement of an inner mandrel that moves independently of an outer sleeve held by the resistance of reaction springs in contact with the casing. However, current axial-loaded slip technology is limited in many areas. Materials and component designs used in existing tools are not optimized for large axial loads (e.g., about 445 kN (100,000 lbf)), and current tools, if used at such loads, can require large release loads and can exhibit poor performance. A "release load" as used herein is the applied axial force required to unset the slips and allow the assembly to again move freely along the length of the wellbore. In addition, the use of existing tools for multiple sets in several wells can lead to increased wear of the tool parts responsible for anchoring the assembly, which results in poor performance or tool failure. Existing slip assembly designs occupy a large portion of the casing cross-sectional area. For example, the existing slip assembly designed to be used in 14 cm (5.50 inch) outer diameter well casing (having an inside diameter as small as 11.9 cm (4.67 inches)) typically has an outer diameter of 11.4 cm (4.50 inches). This small free-flow area between the slip assembly and the casing results in large differential pressures when the slip assembly is exposed to large flow rates in the wellbore. Another weakness of existing designs is the inability to function in the presence of suspended solids in the wellbore fluid. With current designs, the solids can enter the mechanism that cycles the tool, such as a J-latch, and prevent its operation. In addition, existing reaction spring designs can become less effective when exposed to suspended solids.

Accordingly, there is a need for improved apparatus and methods for stabilizing downhole tool assemblies in the wellbore during completion operations.

SUMMARY OF THE INVENTION

According to this invention, a slip assembly apparatus adapted to prevent axial movement of a downhole tool assembly in a wellbore when actuated is provided, said downhole tool assembly comprising an upper portion and a lower portion, and said slip assembly apparatus adapted to be deployed into said wellbore via deployment means and comprising: a) a tubular mandrel having a lower end adapted to be connected to said lower portion of said downhole tool assembly and an upper end; b) a cone having an upper end adapted to be connected to said upper portion of said downhole tool assembly and a lower end adapted to be connected to said upper end of said tubular mandrel wherein said cone tapers outwardly from said tubular mandrel at a predefined angle; c) a tubular sleeve having an upper end and a lower end and surrounding at least a portion of said tubular mandrel; d) a slip surrounding at least a portion of said tubular mandrel, said slip having an upper end comprising two or more dogs, each dog being disposed to slide over said cone when said slip assembly is actuated, and a lower end comprising a fixture adapted to be connected to said upper end of said tubular sleeve; and e) a reaction spring assembly surrounding at least a portion of said tubular mandrel, said reaction spring assembly having two or more reaction springs, each said reaction spring attached at an upper end to an upper reaction spring fixture and attached at a lower end to a lower reaction spring fixture, wherein said upper reaction spring fixture is adapted to be connected to said lower end of said tubular sleeve; all such that said slip assembly apparatus is adapted (i) to prevent axial movement of said downhole tool assembly in said wellbore when said slip assembly apparatus is actuated and external forces are imposed on said downhole tool assembly; (ii) to allow fluid flow past said slip assembly within said wellbore when said slip assembly apparatus is actuated or non-actuated; and (iii) to allow release of said slip assembly apparatus by use of a release load that is less than the axial capacity of said deployment means. In one embodiment, the slip and the cone are treated with a process suitable for improving surface hardness and wear resistance; such process may be salt-bath nitriding. In one embodiment, the reaction springs are clad with a protective coating; such protective coating may comprise tungsten carbide. In one embodiment, the slip includes flutes for enhancing fluid flow past said slip. In one embodiment, the reaction spring assembly includes flutes for enhancing fluid flow past said reaction spring assembly. In one embodiment, a wiper ring suitable for wiping particulate matter from the outer surface of said tubular mandrel is disposed at the upper end of said tubular mandrel; the wiper ring may be adapted to move with said tubular sleeve so as to wipe the outer surface of said tubular mandrel and may be constructed of a material suitable for high temperatures in corrosive environments. In one embodiment, such a wiper ring is disposed at the lower end of said tubular mandrel. In one embodiment, at least one of said reaction springs has a cross section with a radius of curvature that is less than the diameter of said wellbore. In one embodiment, one or more o-rings is disposed between said tubular sleeve and said tubular mandrel. In one embodiment, one or more holes is provided through said tubular sleeve; at least one of said holes is preferably covered with a filter and said filter is preferably suitable for preventing particulates from passing from said wellbore through said hole into said tubular sleeve. In one embodiment, one or more holes is provided through said tubular mandrel. In one embodiment, the predefined angle is about 15 degrees or less. When a slip assembly apparatus according to this invention is to be used in a high temperature, corrosive environment, such as in an acidizing treatment, the slip assembly, or as many parts as possible thereof, is preferably constructed from suitable materials. Such suitable materials include, without limitation, nickel alloys such as INCONEL 625, INCONEL 725, or INCONEL 825. The slip assembly apparatus described and claimed herein is not limited to any particular materials of construction. As will be familiar to those skilled in the art, the slip assembly apparatus may be constructed of any materials suitable for the application in which it is to be used.

Also according to this invention, a method of preventing axial movement of a downhole tool assembly in a wellbore during pumping of a treating fluid into a portion of a subterranean formation intersected by said wellbore is provided, said method comprising: a) deploying a downhole tool assembly within said wellbore via deployment means, said downhole tool assembly comprising a sealing mechanism and a slip assembly, said slip assembly comprising a tubular mandrel, a cone that tapers outwardly from said tubular mandrel at a predefined angle, a tubular sleeve, a slip, and a reaction spring assembly; b) actuating said sealing mechanism so as to establish a hydraulic seal in said wellbore below said portion of said subterranean formation; c) setting said slip assembly so as to provide axial resistance for the sealing mechanism against axial loads created by said pumping of treating fluid; and d) pumping said treating fluid through said wellbore and into said subterranean formation; all such that said slip assembly apparatus (i) prevents axial movement of said downhole tool assembly in said wellbore when said slip assembly is actuated and external forces are imposed on said downhole tool assembly; (ii) allows fluid flow past said slip assembly within said wellbore both when said slip assembly is actuated and non-actuated; and (iii) allows release of said slip assembly apparatus by use of a release load that is less than the axial capacity of said deployment means.

DESCRIPTION OF THE DRAWINGS

The advantages of the present invention will be better understood by referring to the following detailed description and the attached drawings in which.

The same identifier is used throughout the drawings for any particular part.

DETAILED DESCRIPTION OF THE INVENTION

The present invention will be described in connection with its preferred embodiments. However, to the extent that the following description is specific to a particular embodiment or a particular use of the invention, this is intended to be illustrative only, and is not to be construed as limiting the scope of the invention. In particular, all dimensions are provided for purposes of illustration only and do not limit the scope of this invention. On the contrary, the description is intended to cover all alternatives, modifications, and equivalents that are included within the spirit and scope of the invention, as defined by the appended claims.

The present invention discloses improved slip assemblies that allow reliable operation: (i) when large axial setting loads are repeatedly applied; (ii) in the presence of suspended solids that can hinder tool actuation; and/or (iii) when particulate-laden fluid, such as a proppant slurry, must flow around the slip assembly. A slip assembly according to the present invention comprises a tubular mandrel, a cone, a tubular sleeve, a slip and a reaction spring assembly. A slip assembly according to the present invention is not dependent on use of coiled tubing to deploy the downhole tool assembly, and may be used with other suitable deployment means, such as jointed tubing, wireline, or tractor devices.

Figure 1:
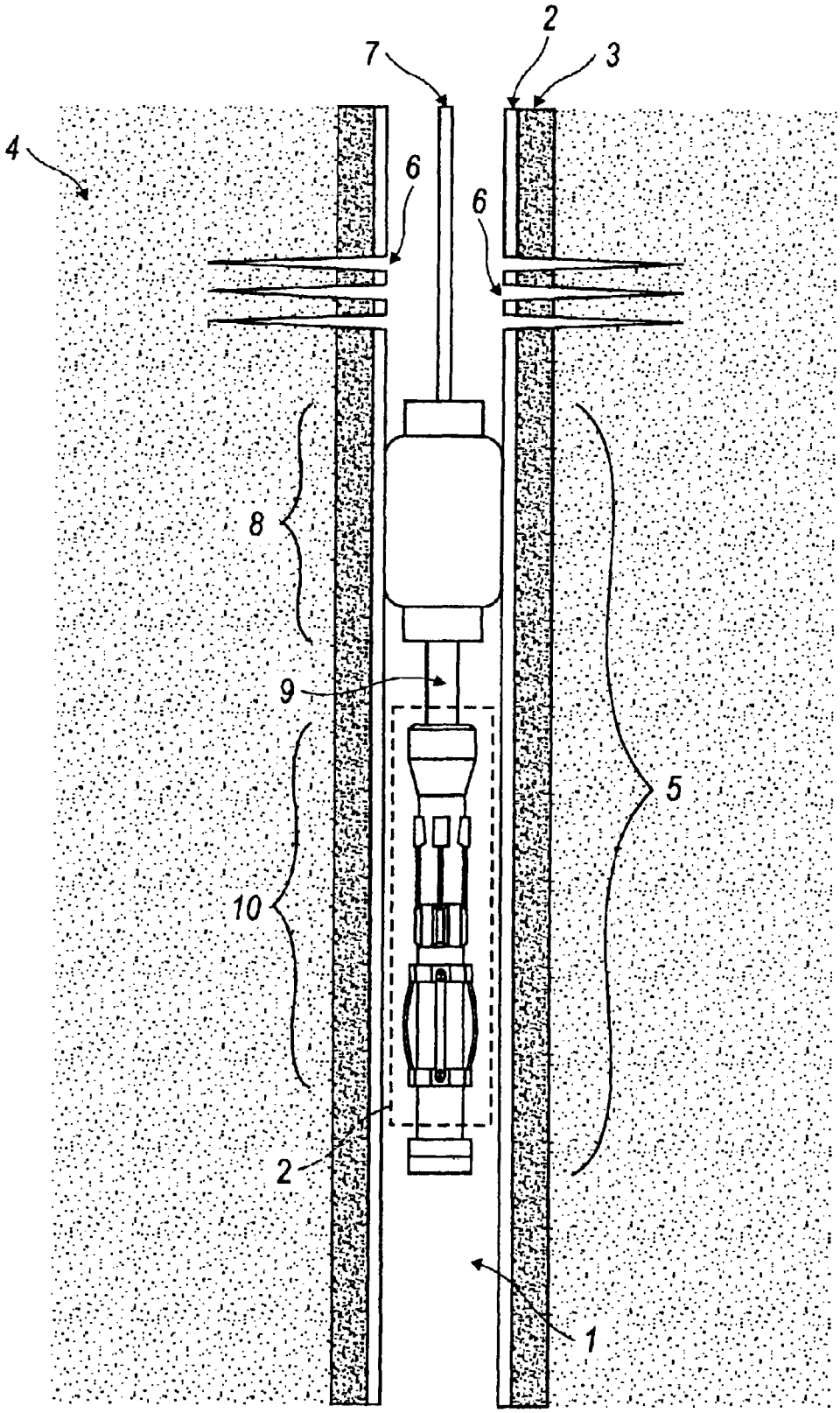
FIG. 1 is a schematic illustration of a slip assembly apparatus according to this invention as part of a downhole tool assembly in a wellbore.
Figure 2:
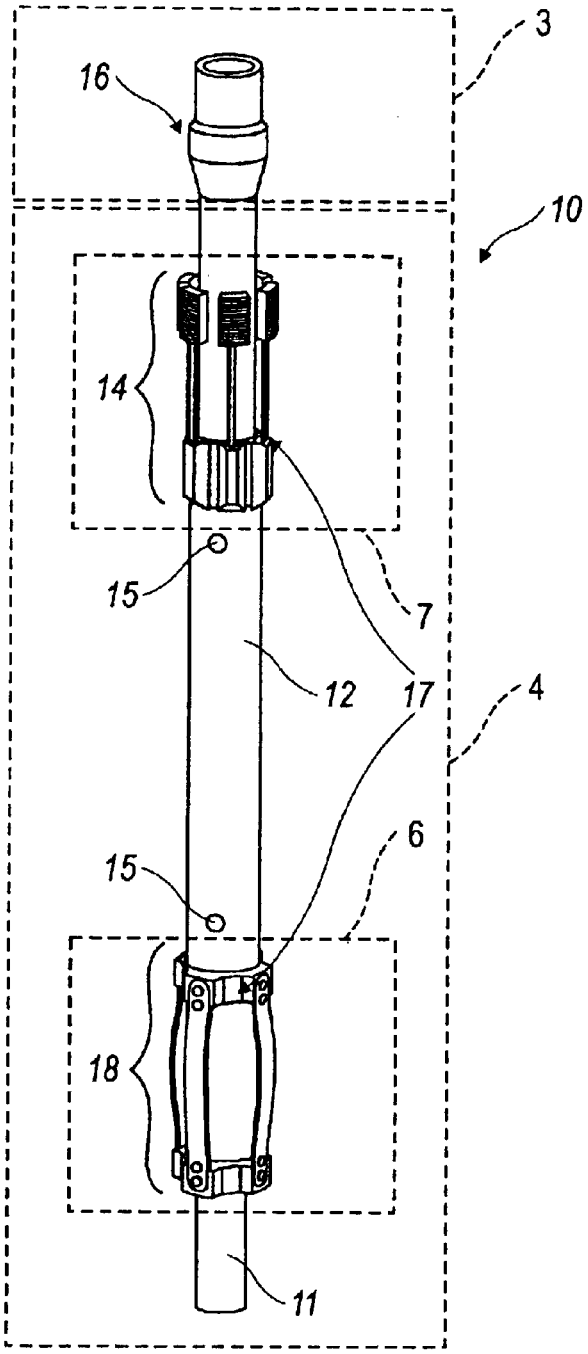
FIG. 2 illustrates one embodiment of the slip assembly apparatus shown in FIG. 1 and having a cone, a tubular mandrel, a tubular sleeve, a slip, a reaction spring assembly, and weep ports.
Figure 3:
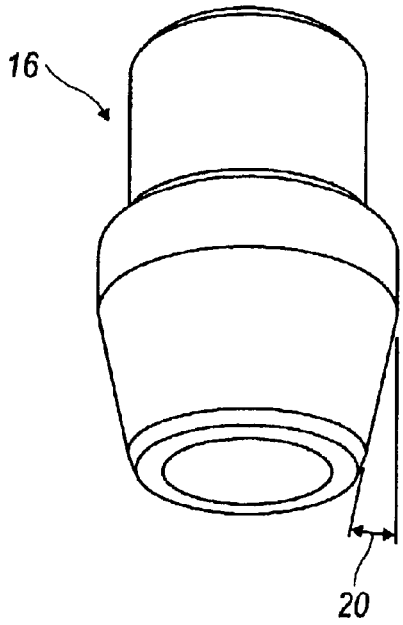
FIG. 3 illustrates one embodiment of the cone shown in FIG. 2.
Figure 4:
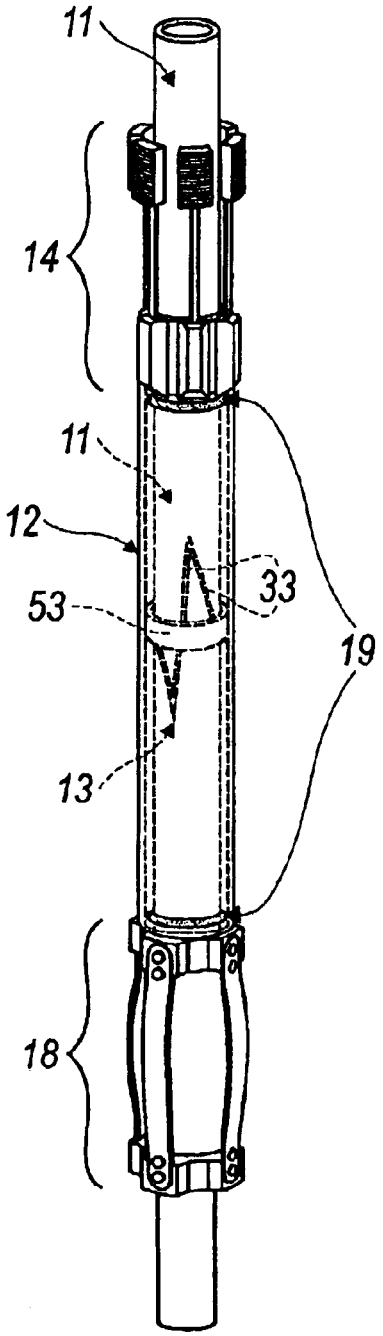
FIG. 4 illustrates one embodiment of the tubular mandrel, tubular sleeve, slip, and reaction spring assembly shown in FIG. 2 and shows the o-ring placement and the cycling mechanism in the tubular mandrel.
Figure 5:
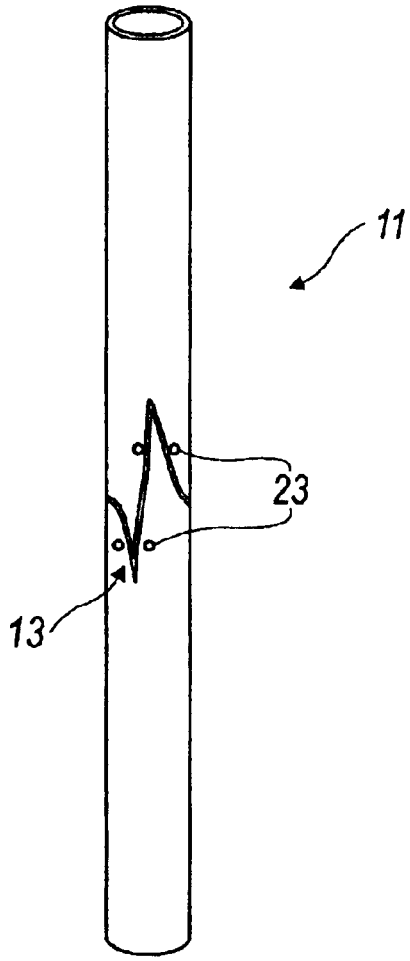
FIG. 5 illustrates one embodiment of the tubular mandrel shown in FIG. 2 and shows the cycling mechanism and fluid communication ports.

FIG. 1 illustrates a slip assembly apparatus according to this invention as part of a downhole tool assembly in a wellbore that could be used in a hydraulic fracturing operation. Wellbore 1 is cased with casing 2, which has been cemented in place by cement 3. Hydraulic communication has been established between wellbore 1 and subterranean formation 4 by perforations 6 through casing 2 and cement 3. Downhole tool assembly 5 is deployed with deployment means 7 into wellbore 1 and comprises packer 8, packer mandrel 9, and slip assembly 10 according to this invention. Downhole tool assembly 5 typically additionally comprises an upper portion, positioned above slip assembly 10 in wellbore 1, and a lower portion, positioned below slip assembly 10 in wellbore 1. Upper and lower portions of downhole tool assembly 5 are not shown in FIG. 1; the make-up of typical upper and lower portions will be familiar to those skilled in the art. For example, upper and lower portions of downhole tool assembly 5 may comprise other tools, including but not limited to perforating guns, wash tools, and depth locators. Downhole tool assembly 5 may be deployed by any suitable means. For example, deployment means 7 may comprise coiled tubing, jointed tubing, tractor devices or wireline, as will be familiar to those skilled in the art.

Throughout this description of the invention, FIG. 1 through FIG. 8 are referenced. These figures illustrate one embodiment of slip assembly 10 having a tubular mandrel 11, a cone 16, a tubular sleeve 12, a slip 14, and a reaction spring assembly 18. Tubular mandrel 11 has an upper end positioned toward the top of wellbore 1, i.e., toward the surface of subterranean formation 4, and a lower end positioned toward the bottom of wellbore 1. The lower end of tubular mandrel 11 is adapted to be connected to the lower portion of downhole tool assembly 5 of which it is typically an integral part. Any suitable connection means may be used, as will be familiar to those skilled in the art. For example, a threaded connection may be used. Tubular mandrel 11 also comprises a cycling mechanism 13, such as a J-latch mechanism having one or more slots 33, a ring 53, and a pin (not shown in the figures) commonly used in the industry for setting and unsetting a slip assembly (see, e.g., FIG. 4). Tubular mandrel 11 may also be adapted to be set by hydraulic means. A cycling mechanism, such as a J-latch, is not a required element of the present invention. Cone 16 has an upper end adapted to be connected to the upper portion of downhole tool assembly 5 or to packer mandrel 9 and a lower end connected at the upper end of tubular mandrel 11. Again, any suitable connection means may be used. Cone 16 tapers at angle 20 outwardly from tubular mandrel 11 (see, e.g., FIG. 3). Angle 20 is predefined by use of calculations familiar to those skilled in the art so that slip assembly 10 is able to support internal and external axial loads imposed on downhole tool assembly 5 while at the same time minimizing the required release load. Preferably the required release load is substantially less than the axial load capacity of the deployment means utilized. In some embodiments of this invention, angle 20 is preferably less than about 15 degrees. Sleeve 12 has an upper end positioned toward the top of wellbore 1, i.e., toward the surface of subterranean formation 4, and a lower end positioned toward the bottom of wellbore 1, when in use, and surrounds at least a portion of tubular mandrel 11. In one embodiment, sleeve 12 preferably has a length sufficient to cover cycling mechanism 13 in tubular mandrel 11. A transparent view through sleeve 12 illustrates cycling mechanism 13 and o-rings 19 located at both ends of sleeve 12 between sleeve 12 and tubular mandrel 11 (see, e.g., FIG. 4). In one embodiment, tubular mandrel 11 may include a J-latch mechanism 13 as a cycling mechanism 13 and one or more fluid communication holes 23 to provide pressure communication between the inside of tubular mandrel 11 and the annulus between tubular mandrel 11 and sleeve 12 (see, e.g., FIG. 5). Fluid communication holes 23 preferably have a very small diameter relative to the surface area of tubular mandrel 11 and more preferably have a diameter of about 2.4 mm (3/32 inch) or less. Slip 14 surrounds at least a portion of tubular mandrel 11 and has an upper end comprising two or more dogs 34 and a lower end comprising fixture 32, wherein the lower end is connected by any suitable means to the upper end of sleeve 12 (see, e.g., FIG. 7). The term "dog" is known to those skilled in the art. A dog is generally considered to be the portion of a slip having gripping teeth on the outside and an angle to match the cone on the inside. Dogs are the portion of a slip that contacts the casing to provide friction to support the axial load imposed on a downhole tool assembly. In this invention, dogs 34 slide over cone 16 when tubular mandrel 11 is moved downward relative to sleeve 12. As is known in the art, this action occurs when the slip assembly is set using the cycling mechanism. When dogs 34 cover cone 16 they move outward at an angle corresponding to cone angle 20 and contact wellbore casing 2, thus stabilizing downhole tool assembly 5.

Reaction spring assembly 18 surrounds at least a portion of tubular mandrel 11. Reaction spring assembly 18 comprises two or more reaction springs 40 held together by upper reaction spring fixture 42 and lower reaction spring fixture 43 (see, e.g., FIG. 6). Upper reaction spring fixture 42 is adapted to be connected by any suitable means to the lower end of sleeve 12. The function of reaction spring assembly 18 in slip assembly 10 is to anchor sleeve 12 to casing 2 enabling tubular mandrel 11 to move in the axial direction relative to sleeve 12. As tubular mandrel 11 moves relative to sleeve 12, a pin (not shown in the drawings) inside the J-latch moves within ring 53, thus enabling slip assembly 10 to set (actuate) and unset, as will be familiar to those skilled in the art.

Currently commercially available slip tools cannot operate reliably in a wellbore containing suspended proppant. In current tools, small diameter proppant can enter the region between the tool body and the mandrel and clog the cycling mechanism. For example, a J-latch mechanism (such as J-latch mechanism 13) typically comprises a 1.27 cm (½ inch) diameter pin that slides through a lubricated slot (such as slot 33). If slot 33 becomes contaminated with even a small amount of particulate matter, the pin may be prevented from moving in the slot and the tool may become jammed. We have found that providing one or more weep ports or holes 15 through tubular sleeve 12 is an effective means of preventing proppant from entering the cycling mechanism region. The weep ports 15 allow hydraulic communication across the seal of o-ring 19 while preventing particulate matter from entering the cycling mechanism region. One or more weep ports 15 in tubular sleeve 12 allow for pressure communication between wellbore 1 and the annular space between tubular mandrel 11 and sleeve 12. Preferably weep ports 15 are blocked by appropriate filters that are adequate to prevent proppant from entering the cycling mechanism 13 and jamming slip assembly 10. Weep ports 15 preferably have a small diameter relative to the surface area of sleeve 12, e.g., weep ports 15 may have a diameter of about 2.4 mm (3/32 inch) or less. Further, we have discovered that if o-rings 19 are used without weep ports 15, the pressure difference across o-rings 19 downhole will be large, thus placing undue stress on the seals. Another embodiments that enables pressure communication across the o-ring seals uses small diameter fluid communication holes 23 drilled in tubular mandrel 11 (see, e.g., FIG. 5). Fluid passing through fluid communication holes 23 will have been filtered before entering the region of fluid communication holes 23, as will be familiar to those skilled in the art. Fluid communication holes 23 allow pressure to be communicated between the inside of tubular mandrel 11 and the annular region between tubular mandrel 11 and sleeve 12. In addition, if desired, the fluid inside tubular mandrel 11 can be in communication, through a filter, with wellbore 1 enabling the annular region between tubular mandrel 11 and sleeve 12 to communicate pressure, but not contaminants, with wellbore 1. In yet another embodiment, use of o-rings 19 constructed from material, such as for example VITON, that is suitable for high temperatures (i.e., greater than about 149° C. (300° F.)) allow usage of slip assembly 10 in oil and gas wells where high temperatures are prevalent.

Figure 6:
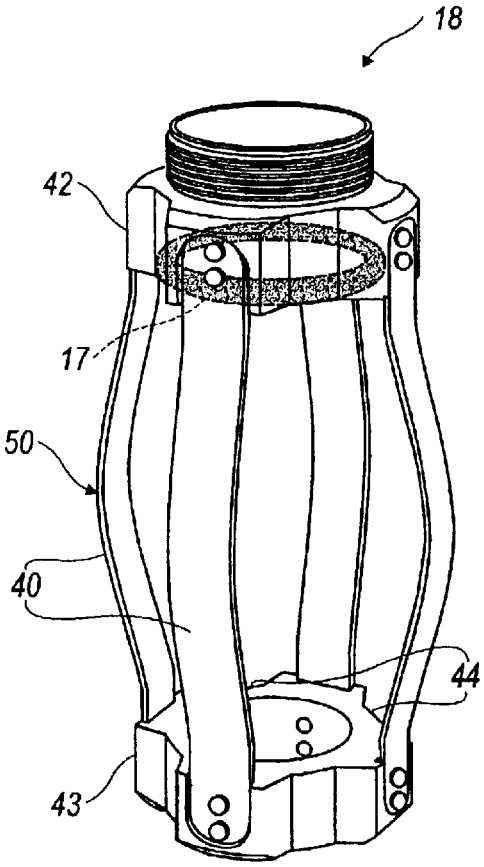
FIG. 6 illustrates one embodiment of the reaction spring assembly shown in FIG. 2 and shows a wiper ring.
Figure 7:
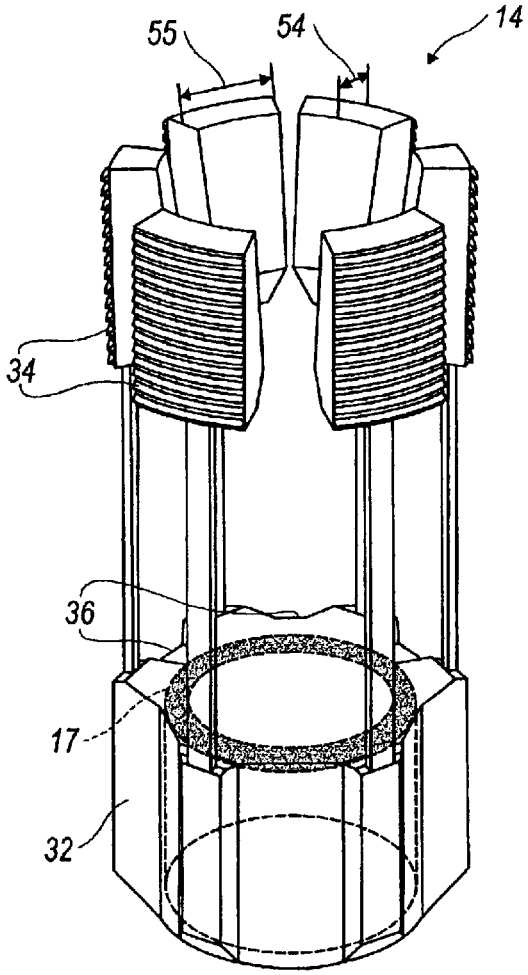
FIG. 7 illustrates one embodiment of the slip shown in FIG. 2 and shows a wiper ring.
Figure 8:
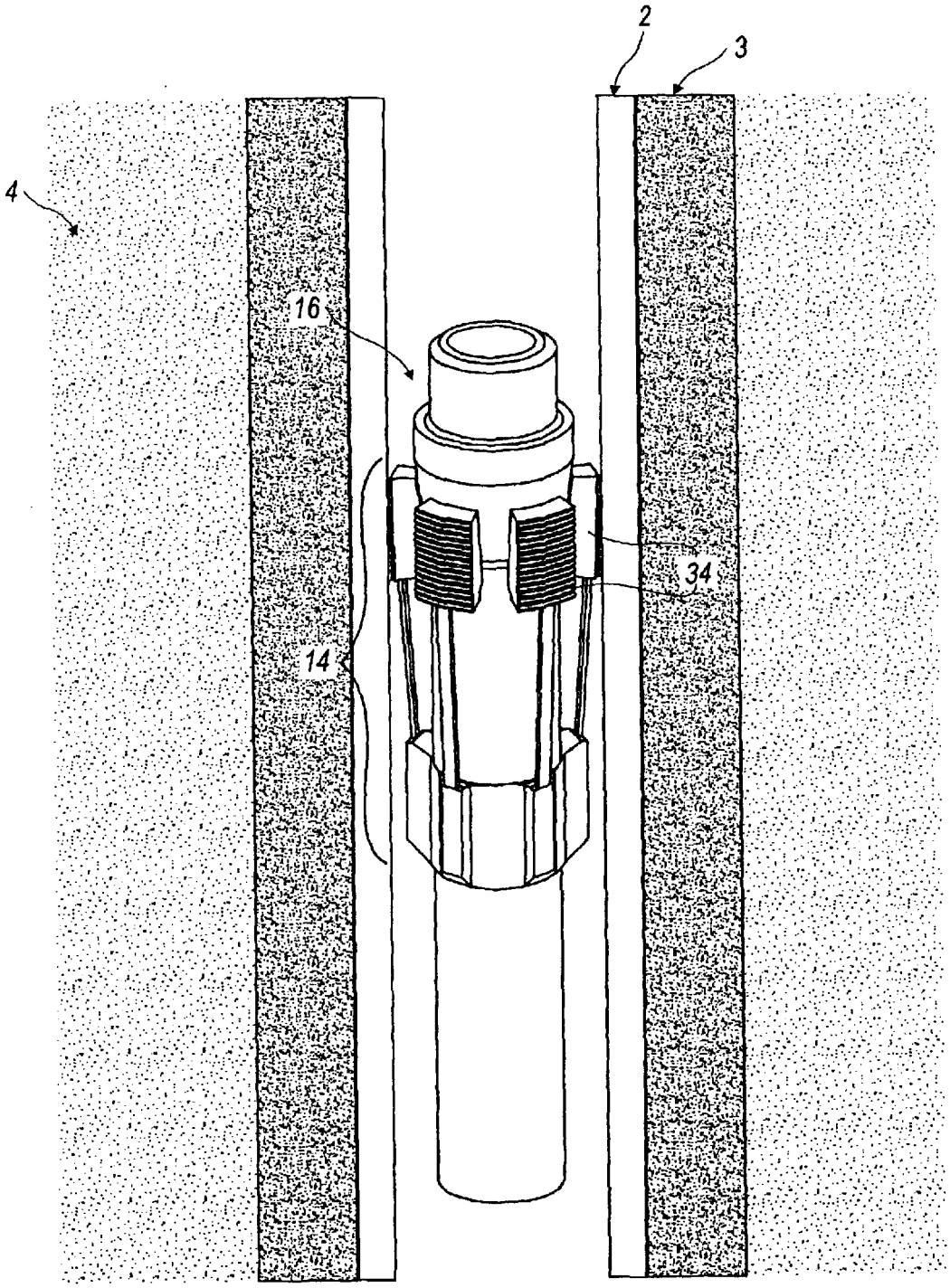
FIG. 8 illustrates the positioning of the slip shown in FIG. 7 and the cone shown in FIG. 3 within a wellbore.

In a further embodiment, a wiper ring 17 may be provided at one or both ends of tubular mandrel 11, e.g., where fixture 32 of slip 14 contacts tubular mandrel and where upper reaction spring fixture 42 of reaction spring assembly 18 contacts tubular mandrel 11 (see, e.g., FIG. 6 and FIG. 7). Wiper rings 17 are adapted to move with sleeve 12 during actuation of slip assembly 10 such that wiper rings 17 wipe particulate matter from the surface of tubular mandrel 11. Wiper rings 17 are preferably fabricated from durable materials that are suitable for high temperatures in corrosive environments, such as TEFLON, as will be familiar to those skilled in the art. Also, wiper rings 17 are preferably machined to a tight diametrical tolerance with respect to tubular mandrel 11 so that they perform the desired function of wiping particulate matter from the surface of tubular mandrel 11 as downhole tool assembly 5 is cycled. When particles are removed with one or more wiper rings 17, slip assembly 10 is better able to set in the presence of proppant slurries without particulate matter clogging cycling mechanism 13 or increasing the friction between sleeve 12 and tubular mandrel 11. O-rings 19 can also serve as secondary barriers (wiper rings 17 being the primary barriers) to particulate contamination of the region of cycling mechanism 13. In applications where very small particulates, such as those resulting from proppant crushing, could be present, wiper rings 17 are preferably in physical contact with tubular mandrel 11 to provide improved wiping. The improved wiping must be balanced against the increased friction on tubular mandrel 11, and care must be taken not to increase the friction too high thereby preventing reaction springs 40 from providing sufficient friction to enable downhole tool assembly 5 to cycle.

Another embodiment that enables operation of slip assembly 10 in particulate-laden slurries is a surface treatment to tubular mandrel 11 and/or to sleeve 12. By coating, e.g., tubular mandrel 11 with a low friction, wear resistance material like hard chrome, the additional friction introduced by contact wipers, such as wiper rings 17, can be minimized or offset completely. Such a coating also minimizes the likelihood of galling between tubular mandrel 11 and sleeve 12. Such galling, if not minimized, could greatly increase the friction and lead to a tool failure. The galling could occur if metal from wellbore 1 (e.g., perforation debris) entered the region between tubular mandrel 11 and tubular sleeve 12. While this debris would likely not get past o-rings 19, it could get past the small clearance wiper rings 17 and lead to increased friction or galling of any non-coated metal surfaces. The combination of zero-clearance wiper rings 17 and coated tubular mandrel 11 minimizes the likelihood of encountering increased friction within slip assembly 10. Sleeve 12 may also be coated to minimize galling.

When large axial loads are applied to currently available slip tools, the loads required to release the tool become large.

In addition, when large axial loads are repeatedly applied, wear and damage to the tool can lead to poor tool performance or failure. In one embodiment of this invention, a high yield-strength, high hardness material (for example, 17-4 PH1025 stainless steel) is used to construct slip 14 and cone 16. Use of this type of material allows slip assembly 10 to be set more times at larger axial loads with reduced damage to the teeth of slip 14 and reduced damage to the sliding surfaces on both slip 14 and cone 16. In another embodiment, the high strength and hardness base material of slip 14 and cone 16 is treated with a process, such as salt-bath nitriding, to increase the surface hardness and wear resistance even more. This process can produce a surface that exhibits low friction behavior (friction coefficient $\mu \approx 0.3$) when in contact with a similar surface. Reduced friction between cone 16 and dogs 34 can lead to lower release loads than are possible with currently available tools.

In another embodiment of this invention, the geometry of slip assembly 10 is modified to improve performance. Existing tools utilize cone and dog angles that produce large release loads (about 133.5 kN (30,000 lbf) for a 445 kN (100,000 lbf) set load). For our invention, we have discovered that angle 20 of cone 16, and thus the corresponding angle of dogs 34 when slip assembly 10 is set, can be selected to minimize or reduce release loads while still being capable of holding large axial setting loads. By increasing cone angle 20 by a predetermined amount, lower radial forces are transferred to casing 2 which leads to reduced wear on the teeth of dogs 34 for multiple settings and reduced potential for damage to casing 2. The cone and dog angle 20 can be set such that when slip assembly 10 is set, the toothy surfaces of dogs 34 are parallel to casing 2. See FIG. 8, which shows the position of cone 16 and slip 14, having dogs 34, within casing 2. The appropriate angle 20 may be determined by using analytical and finite element methods validated with full-scale experiments. The analytical methods utilize free-body diagrams to identify and calculate the forces being applied to the slip assembly components and the casing. The finite element methods utilize commercially available software to model the tool components and determine stresses generated for a given axial load and tool geometry. Full-scale experiments allow for confirmation of the theoretical results and verification that the tool will successfully hold axial loads in a specified range. The details associated with these methods are known to those skilled in the art.

In some completion operations, it is beneficial and even required to be able to flow treating fluids past equipment in the downhole tool assembly, which includes the slip assembly. Because of the small annular clearance between a slip assembly and the wellbore, current tool designs do not accommodate flow past the tool without large pressure differentials. In one embodiment of this invention, wellbore fluids flow past slip assembly 10, both in set and unset positions, with a reduced pressure differential. By reducing the outer diameter of slip assembly 10, the free-flow area between slip assembly 10 and casing 2 is increased thereby reducing the pressure required to flow past slip assembly 10. In order to enable an overall smaller diameter tool body (including, e.g., sleeve 12, cone 16, and tubular mandrel 11) to effectively operate in wellbore 1, however, we have provided an improved slip 14 that facilitates flow of treating fluids around slip assembly 10. Referring to FIG. 7, slip 14 comprises fixture 32 at the lower end and a plurality of dogs 34 at the upper end. Means for allowing fluid flow past slip 14 are provided, such as indentions or grooves in fixture 32 or attachments thereto. For example, flutes 36 may be provided in fixture 32. The free-flow area is thereby increased around slip assembly 10 and the pressure drop across slip assembly 10 is decreased. In another embodiment, the thickness 54 of dogs 34 is increased so that slip assembly 10 can be set using a smaller diameter cone 16, tubular mandrel 11 and sleeve 12, resulting in increased free-flow area. The amount of increase in thickness 54 is determined by inside diameter of casing 2 and by outer diameter of cone 16. When slip assembly 10 is in the set position, the free-flow area is the cross-sectional area between adjacent dogs 34. This region is bounded by the inner wall of casing 2, the outer diameter of cone 16, and the edges of adjacent dogs 34. Those skilled in the art can use geometry to calculate this free-flow area for a given slip assembly 10 and casing 2 geometry. In yet another embodiment, we have discovered that the number of dogs 34 and the width 55 of each dog 34 can be varied to enhance the flow area and reduce the pressure drop across slip assembly 10 when it is in the set position (i.e., dogs 34 have slid up cone 16 and are in contact with well casing 2). While reducing the number and width 55 of dogs 34 creates a larger free-flow area, it simultaneously reduces the dog-casing contact area. Reduced dog-casing contact area leads to increased radial stress in slip assembly 10 and higher stresses transferred to casing 2 for a given axial setting load. Sufficient dog-casing contact area should be retained to support the required axial load without damaging slip assembly 10 or producing large stresses that could damage casing 2. Application of the present invention is specific to the given application (required axial load, casing yield strength, casing wall thickness, etc.) and can be determined by one skilled in the art.

In another embodiment of this invention, the reaction spring assembly is modified to facilitate flow of fluid around the slip assembly. FIG. 6 illustrates one embodiment of an improved reaction spring assembly. Reaction spring assembly 18 comprises a plurality of reaction springs 40 connected by upper reaction spring fixture 42 and lower reaction spring fixture 43. By increasing the outer diameters of fixtures 42 and 43, the reaction springs 40 are displaced to a larger diameter. With reaction springs 40 at a larger diameter, a smaller diameter sleeve 12 can be utilized in a particular size of casing 2. In another embodiment, means for allowing fluid flow past slip assembly 10 are provided, such as indentions or grooves in fixtures 43 and 42 or attachments thereto. For example, flutes 44 may be provided in fixtures 43 and 42 to further increase the free-flow area around and decrease the pressure drop across slip assembly 10.

When slip assembly 10 is moved axially in wellbore 1 in the presence of suspended proppant, the proppant can lead to increased wear on reaction springs 40. If reaction springs 40 wear too much, they can fail to produce the required friction to allow slip assembly 10 to be cycled thereby leading to a potential failure of slip assembly 10. In one embodiment, reaction springs 40 are clad with a protective coating, such as a coating containing tungsten carbide, to enhance wear resistance.

Flat, rectangular cross-sections found in currently available reaction springs result in a small region between the spring and the casing wall that can retain proppant. The proppant, usually small diameter spherical particles, can act as ball bearings thereby lubricating the reaction springs and the casing wall. The reduced friction can produce a situation where the friction between the lubricated reaction spring and the casing wall is not sufficient to overcome the friction between the sleeve and the tubular mandrel. If this situation occurs, the slip assembly may be prevented from setting and could slide, as a whole, axially within the wellbore without ever engaging the casing. We have discovered a solution to this problem in yet another embodiment of this invention. In this embodiment, the cross-section of reaction springs 40 is curved with a radius of curvature less than the diameter of casing 2. With this inventive feature, reaction springs 40 contact casing 2 along the tangent 50 of the cross-section, thus eliminating the gap between reaction spring 40 and casing 2.

EXAMPLE

As a result of theoretical analysis, numerical simulations and experimental testing, the following data have been developed for a slip assembly 10 according to this invention to be used in a well casing 2 with a 14 cm (5.50 inch) outside diameter and 11.9 cm (4.67 inch) inside diameter. The cone 16 and dogs 34 are made of 17-4 PH1025 stainless steel with a salt-bath nitride surface treatment. The cone 16 has a 15° angle 20 with a base diameter of 9.7 cm (3.80 inches). The dogs 34 have a 13° corresponding angle on the inside surface and a −2° taper along the teeth. The slip 14 comprises six dogs 34 each with a 37° arc width, and has flutes 36 with a base diameter of 8.8 cm (3.46 inches) and an outer diameter of 11.4 cm (4.50 inches). The reaction spring assembly 18 has a spring-to-spring diameter of 10.2 cm (4.00 inches) with flutes 44 between the springs 40 with a maximum outer diameter of 11.4 cm (4.50 inches). The reaction spring assembly 18 is made of 17-4 PH1025 stainless steel. The tool body (sleeve 12) has an outer diameter of 8.9 cm (3.50 inches). Wiper rings 17 with an inner diameter of 6.4 cm (2.52 inches) are made of TEFLON. Eight, 1.6 mm (1/16 inch) diameter fluid communication holes 23 are drilled in tubular mandrel 11 whose outer diameter is 6.4 cm (2.5 inches). The small diameter fluid communication holes 23 are located adjacent to the slot 33 of the J-latch 13 to ensure that the holes 23 are protected by both the wipers 17 and the o-rings 19.

Figure 9:
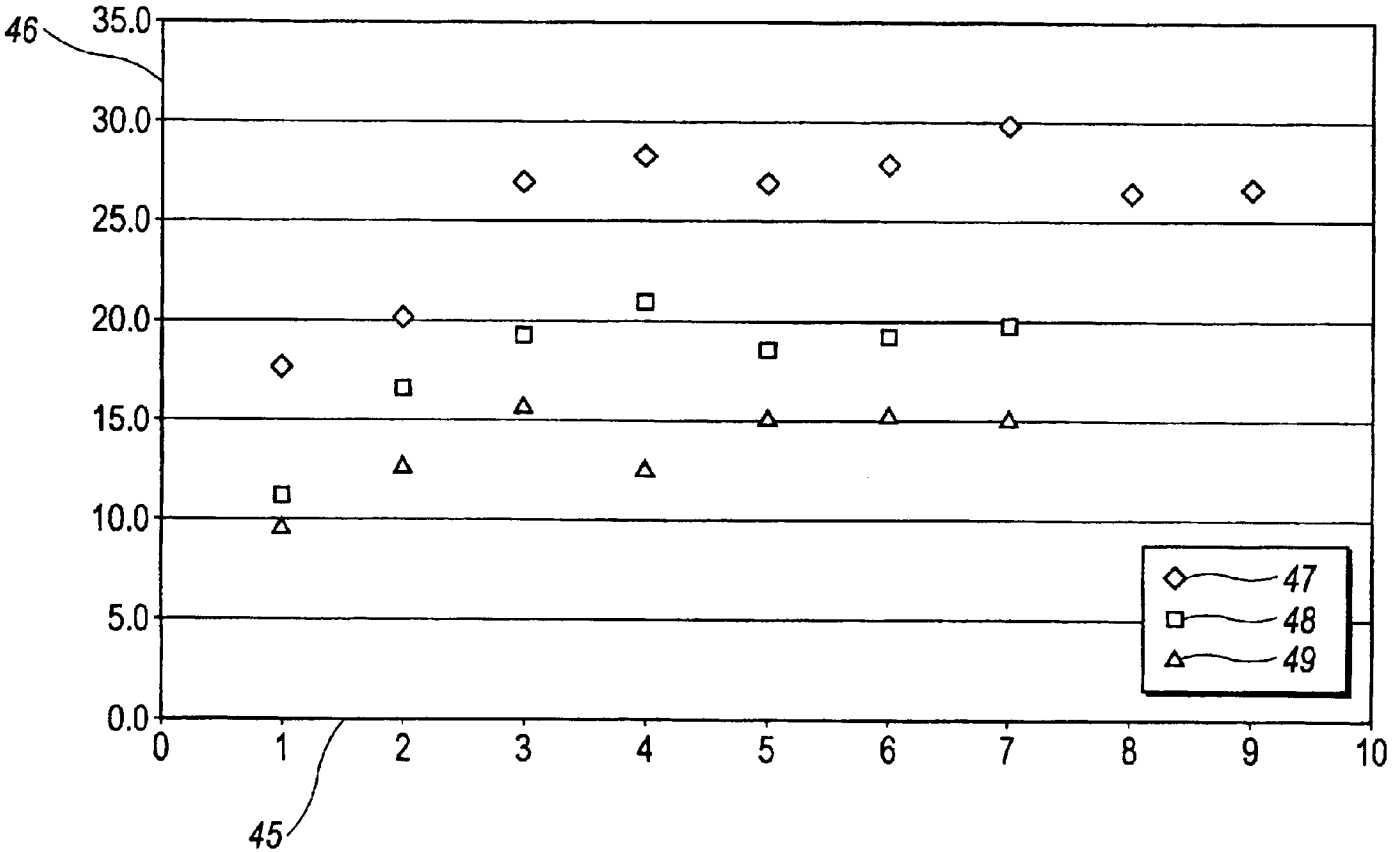
FIG. 9 is a graph showing experimental results of release load as a function of set number for different cone angles using the present invention.

An experimental testing program was conducted to evaluate a slip assembly 10 according to this invention. Several of the embodiments were evaluated using finite element computation methods, and the numerical results along with preliminary experimental data were used to guide implementation. Full-scale experiments were conducted with a downhole tool assembly 5 for 9°, 12°, and 15° cone angle 20. During the experiments, downhole tool assembly 5 was subjected to a large axial load (nominally 445 kN (100,000 lbf or 100 kips)) for a one minute duration. The load was then removed and a compressive axial load was applied to release the tool assembly. FIG. 9 shows the release load results for multiple settings of the tool assembly for each of the cone angles. FIG. 9 has an abscissa 45 representing set number (e.g., set no. 1, set no. 2, etc.) and an ordinate 46 representing release load in thousands of pounds (kips); data is shown for a cone angle of 9 degrees 47, for a cone angle of 12 degrees 48, and for a cone angle of 15 degrees 49. For all three angles, initial release loads were low, about 40.1 to 80.1 kN (9 to 18 kips), but after the third set, the release loads leveled out at approximately 120.1 kN (27 kips) for the 9° cone, 84.6 kN (19 kips) for 12° and 66.8 kN (15 kips) for 15°. From these results, one skilled in the art can see that the improvements of the present invention reduced the axial release load by 45% for the case of the 15° cone angle when compared to the 9° cone angle used in existing slips designs.

Analytical modeling was used to evaluate the impact of the improvements provided by this invention on pressure drop across a slip assembly. Existing designs use a 11.4 cm (4.50 inch) tool body to set the tool in 11.9 cm (4.67 inch) inside diameter (14 cm (5.50 inch) outside diameter, 0.08 kip/m (23 lbf/foot)) casing. The pressure drop associated with flowing 24° C. (75° F.) water at 2 barrels/minute past the existing tool is estimated to be 241.2 kPa (35 psi). The pressure drops associated with the novel improvements for flow at the same rate is substantially lower: 2.8 kPa (0.4 psi), 4.1 kPa (0.6 psi), and 4.5 kPa (0.65 psi) for 9°, 12°, and 15° cone angles, respectively. In this test, the slip assembly demonstrated a 45% lower release load and an estimated pressure drop of less than 2% of the value expected using currently available technology.

The foregoing description has been directed to particular embodiments of the invention for the purpose of illustrating the invention, and is not to be construed as limiting the scope of the invention. In particular, all dimensions are provided for purposes of illustration only and do not limit the scope of this invention. It will be apparent to persons skilled in the art that many modifications and variations not specifically mentioned in the forgoing description will be equivalent in function for the purposes of this invention. All such modifications, variations, alternatives, and equivalents are intended to be within the spirit and scope of the present invention, as defined by the appended claims.

We claim:

1. A slip assembly apparatus adapted to prevent axial movement of a downhole tool assembly in a wellbore when actuated, said downhole tool assembly comprising an upper portion and a lower portion, and said slip assembly apparatus adapted to be deployed into said wellbore via deployment means and comprising:

a) a tubular mandrel having a lower end adapted to be connected to said lower portion of said downhole tool assembly and an upper end;

b) a cone having an upper end adapted to be connected to said upper portion of said downhole tool assembly and a lower end adapted to be connected to said upper end of said tubular mandrel wherein said cone tapers outwardly from said tubular mandrel at a predefined angle;

c) a tubular sleeve having an upper end and a lower end and surrounding at least a portion of said tubular mandrel;

d) a slip surrounding at least a portion of said tubular mandrel, said slip having an upper end comprising two or more dogs, each dog being disposed to slide over said cone when said slip assembly is actuated, and a lower end comprising a fixture adapted to be connected to said upper end of said tubular sleeve; and e) a reaction spring assembly surrounding at least a portion of said tubular mandrel, said reaction spring assembly having two or more reaction springs, each said reaction spring attached at an upper end to an upper reaction spring fixture and attached at a lower end to a lower reaction spring fixture, wherein said upper reaction spring fixture is adapted to be connected to said lower end of said tubular sleeve;

further comprising at least one feature from the group consisting of (1) said slip and said cone are treated with a process suitable for improving surface hardness and wear resistance;

(2) said reaction springs are clad with a protective coating;

(3) said slip includes flutes for enhancing fluid flow past said slip; and (4) said reaction spring assembly includes flutes for enhancing fluid flow past said reaction spring assembly;

all such that said slip assembly apparatus is adapted (i) to prevent axial movement of said downhole tool assembly in said wellbore when said slip assembly apparatus is actuated and external forces are imposed on said downhole tool assembly; (ii) to allow fluid flow past said slip assembly within said wellbore when said slip assembly apparatus is actuated or non-actuated; and (iii) to allow release of said slip assembly apparatus by use of a release load that is less than the axial capacity of said deployment means.

2. The apparatus of claim 1 wherein said slip and cone treatment process is salt-bath nitriding.

3. The apparatus of claim 1 wherein said protective coating on the reaction springs comprises tungsten carbide.

4. The apparatus of claim 1 wherein a wiper ring suitable for wiping particulate matter from the outer surface of said tubular mandrel is disposed at the upper end of said tubular mandrel.

5. The apparatus of claim 4 wherein said wiper ring is adapted to move with said tubular sleeve so as to wipe the outer surface of said tubular mandrel.

6. The apparatus of claim 4 wherein said wiper ring is made of a material suitable for high temperatures in corrosive environments.

7. The apparatus of claim 1 wherein a wiper ring suitable for wiping particulate matter from the outer surface of said tubular mandrel is disposed at the lower end of said tubular mandrel.

8. The apparatus of claim 7 wherein said wiper ring is adapted to move with said tubular sleeve so as to wipe the outer surface of said tubular mandrel.

9. The apparatus of claim 7 wherein said wiper ring is made of a material suitable for high temperatures in corrosive environments.

10. The apparatus of claim 1 wherein at least one of said reaction springs has a cross section with a radius of curvature that is less than the diameter of said wellbore.

11. The apparatus of claim 1 wherein one or more o-rings is disposed between said tubular sleeve and said tubular mandrel.

12. The apparatus of claim 1 wherein one or more holes is provided through said tubular sleeve.

13. The apparatus of claim 12 wherein at least one of said holes is covered with a filter.

14. The apparatus of claim 13 wherein said filter is suitable for preventing particulates from passing from said wellbore through said hole into said tubular sleeve.

15. The apparatus of claim 1 wherein one or more holes is provided through said tubular mandrel.

16. The apparatus of claim 1 wherein said predefined angle is about 15 degrees or less.

17. The apparatus of claim 1 wherein said predefined angle is more than about 9 degrees.

18. The apparatus of claim 1 wherein said predefined angle is in the range from about 9 degrees to about 15 degrees.

19. The apparatus of claim 1 wherein said predefined angle is determined by considerations including reducing said release load while still holding large axial setting loads.

20. A method of preventing axial movement of a downhole tool assembly in a wellbore during pumping of a treating fluid into a portion of a subterranean formation intersected by said wellbore, said method comprising:

a) deploying a downhole tool assembly within said wellbore via deployment means, said downhole tool assembly comprising a sealing mechanism and a slip assembly, said slip assembly comprising a tubular mandrel, a cone that tapers outwardly from said tubular mandrel at a predefined angle, a tubular sleeve, a slip, and a reaction spring assembly, said downhole tool assembly further comprising at least one feature from the group consisting of:

(1) said slip and said cone are treated with a process suitable for improving surface hardness and wear resistance;

(2) said reaction springs are clad with a protective coating;

(3) said slip includes flutes for enhancing fluid flow past said slip; and (4) said reaction spring assembly includes flutes for enhancing fluid flow past said reaction spring assembly;

b) actuating said sealing mechanism so as to establish a hydraulic seal in said wellbore below said portion of said subterranean formation;

c) setting said slip assembly so as to provide axial resistance for the sealing mechanism against axial loads created by said pumping of treating fluid; and d) pumping said treating fluid through said wellbore and into said subterranean formation;

all such that said slip assembly apparatus (i) prevents axial movement of said downhole tool assembly in said wellbore when said slip assembly is actuated and external forces are imposed on said downhole tool assembly; (ii) allows fluid flow past said slip assembly within said wellbore both when said slip assembly is actuated and non-actuated; and (iii) allows release of said slip assembly apparatus by use of a release load that is less than the axial capacity of said deployment means.

* * * * *